US008294355B2

(12) United States Patent
Liu et al.

(10) Patent No.: US 8,294,355 B2
(45) Date of Patent: Oct. 23, 2012

(54) FIELD EMISSION DEVICE AND FIELD EMISSION DISPLAY USING SAME

(75) Inventors: Peng Liu, Beijing (CN); Duan-Liang Zhou, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/187,713

(22) Filed: Jul. 21, 2011

(65) Prior Publication Data

US 2012/0153810 A1 Jun. 21, 2012

(30) Foreign Application Priority Data

Dec. 16, 2010 (CN) ..... 2010 1 0591539

(51) Int. Cl.
*H01J 1/62* (2006.01)
*H01J 63/04* (2006.01)

(52) U.S. Cl. ..... 313/495; 313/483; 313/497; 313/496

(58) Field of Classification Search ..... None
See application file for complete search history.

(56) References Cited

U.S. PATENT DOCUMENTS

| | | | | |
|---|---|---|---|---|
| 7,772,755 | B2 * | 8/2010 | Liu et al. | 313/306 |
| 7,915,798 | B2 * | 3/2011 | Liu et al. | 313/310 |
| 7,982,382 | B2 * | 7/2011 | Liu et al. | 313/310 |
| 7,990,042 | B2 * | 8/2011 | Liu et al. | 313/495 |
| 8,007,336 | B2 * | 8/2011 | Liu et al. | 445/51 |
| 8,072,127 | B2 * | 12/2011 | Liu et al. | 313/310 |
| 8,110,975 | B2 * | 2/2012 | Liu et al. | 313/495 |
| 2009/0160312 | A1 * | 6/2009 | Liu et al. | 313/495 |
| 2009/0167136 | A1 * | 7/2009 | Liu et al. | 313/306 |
| 2009/0195140 | A1 * | 8/2009 | Wei et al. | 313/307 |
| 2009/0236965 | A1 * | 9/2009 | Liu et al. | 313/495 |
| 2010/0039015 | A1 * | 2/2010 | Liu et al. | 313/306 |
| 2011/0241537 | A1 * | 10/2011 | Liu et al. | 313/498 |
| 2012/0062100 | A1 * | 3/2012 | Liu et al. | 313/310 |
| 2012/0169212 | A1 * | 7/2012 | Liu et al. | 313/498 |
| 2012/0169221 | A1 * | 7/2012 | Liu et al. | 313/506 |
| 2012/0169222 | A1 * | 7/2012 | Liu et al. | 313/506 |

* cited by examiner

*Primary Examiner* — Natalie Walford
(74) *Attorney, Agent, or Firm* — Altis Law Group, Inc.

(57) ABSTRACT

A field emission device includes a cathode, an anode, an emitter, a first adjusting electrode, and a second adjusting electrode. The emitter electrically connects to the cathode. The cathode, the first adjusting electrode, and the second adjusting electrode electrically connect to an electrode down-lead. The anode electrically connects another electrode down-lead. The cathode is disposed between the first adjusting electrode and the second adjusting electrode.

20 Claims, 7 Drawing Sheets

FIELD EMISSION DEVICE AND FIELD EMISSION DISPLAY USING SAME

CROSS-REFERENCE TO RELATED APPLICATIONS

This application claims all benefits accruing under 35 U.S.C. §119 from China Patent Application No. 201010591539.0, filed on Dec. 16, 2010 in the China Intellectual Property Office, disclosure of which is incorporated herein by reference.

BACKGROUND

1. Technical Field

The present disclosure relates to field emission devices, especially to a field emission device with two adjusting electrodes, and a field emission display using the same.

2. Description of Related Art

Field emission displays (FEDs) are a novel, rapidly developing flat panel display technology. Compared to conventional displays, such as cathode-ray tube (CRT) and liquid crystal display (LCD), FEDs are superior in providing a wider viewing angle, lower energy consumption, smaller size, fast response, and higher quality.

A conventional field emission device of a field emission display generally includes an anode, a cathode, an emitter, and a fluorescent layer disposed on a surface of the anode. When the field emission device is operated, the cathode provides an electrical potential to the emitter, which causes the emitter to emit electrons according to the electrical potential. The anode also provides an electrical potential to accelerate the emitted electrons to bombard the fluorescent layer for luminance.

However, it is difficult to control the emission direction of the electrons to bombard the fluorescent layer, therefore only a part of the electrons hits the fluorescent layer for luminance due to deflection of the electrons. Simultaneously, cross-talk phenomenon occurs during the operation of the field emission display, thus the luminous efficiency of the field emission display using the conventional field emission device is decreased.

What is needed, therefore, is to provide a field emission device having two adjusting electrodes, which can control emission directions of electrons emitted from a cathode.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
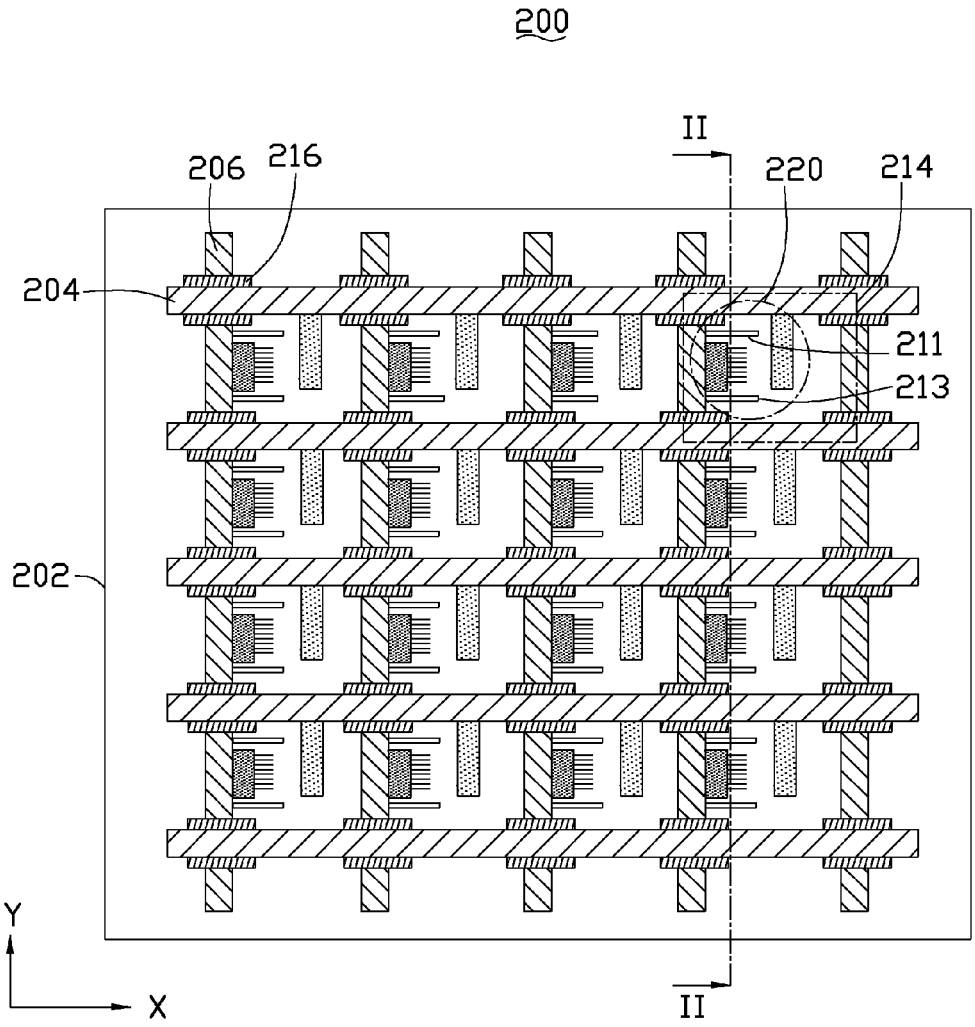
FIG. 1 is a schematic view of one embodiment of a field emission display.
Figure 2:
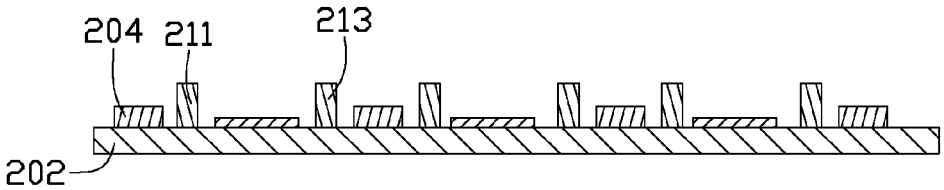
FIG. 2 is a cross-section of the field emission display shown in FIG. 1 taken along a line II-II thereof.

Referring to FIG. 1, a field emission display 200 according to one embodiment is shown. The field emission display 200 includes an insulating substrate 202, a number of column electrode down-leads 204, a number of row electrode down-leads 206, a number of isolating elements 216, and a number of field emission devices 220. Also referring to FIG. 2, each of the field emission devices 220 is disposed on the insulating substrate 202, and includes a first adjusting electrode 211 and a second adjusting electrode 213.

The row electrode down-leads 206 are disposed on the insulating substrate 202, and arranged substantially along a first direction, such as an X direction shown in FIG. 1, in parallel at a regular interval. Similarly, the column electrode down-leads 204 are disposed on the insulating substrate 202, and arranged substantially along a second direction, such as a Y direction shown in FIG. 1, in parallel at a regular interval. The first direction is substantially perpendicular to the second direction. The isolating elements 216 electrically isolate the row electrode down-leads 206 from the column electrode down-leads 204 to avoid a short circuit between the row electrode down-leads 206 and the column electrode down-leads 204. Every two neighboring row electrode down-leads 206 and every two neighboring column electrode down-leads 204 define a space 214. Each of the field emission devices 220 is disposed in one corresponding space 214. The first adjusting electrode 211 and the second adjusting electrode 213 of each of the field emission devices 220 extend substantially along the X direction.

Figure 3:
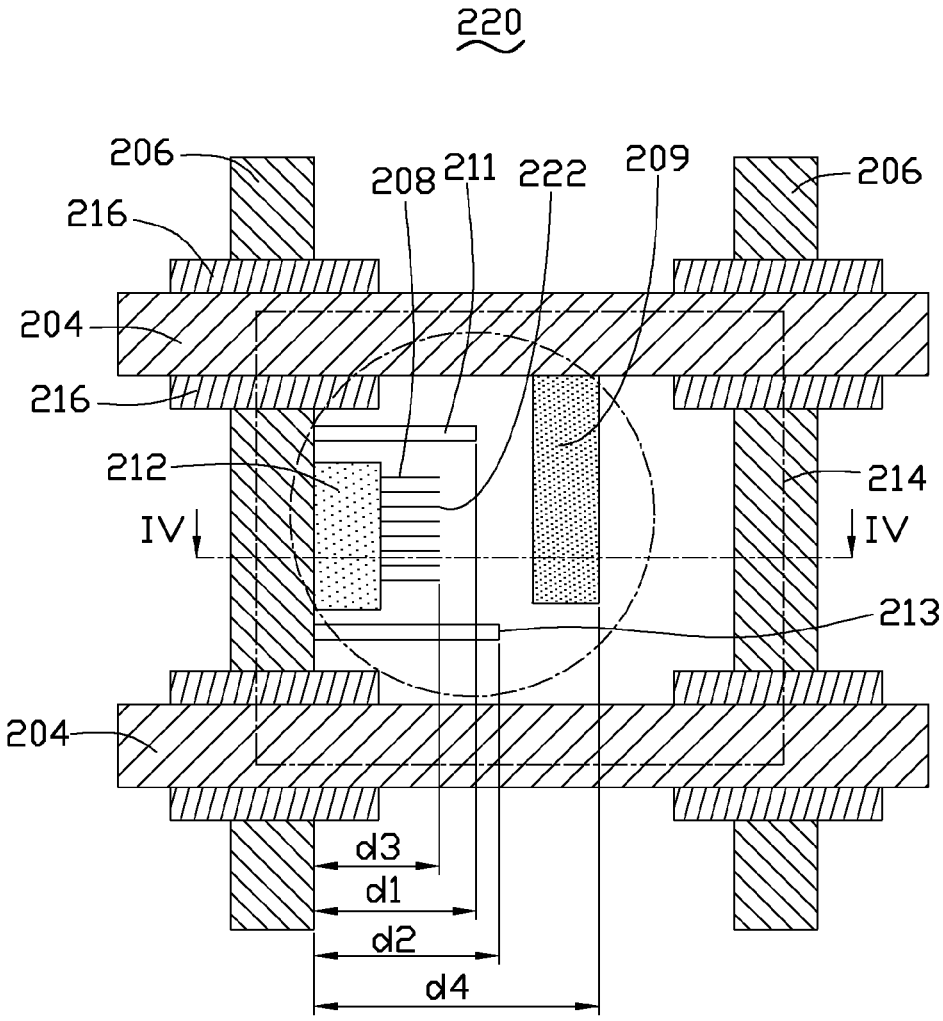
FIG. 3 is a schematic view of one embodiment of a field emission device of the field emission display shown in FIG. 1.
Figure 4:
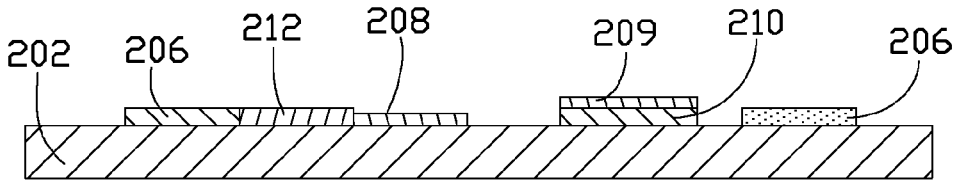
FIG. 4 is a cross-section of the field emission device shown in FIG. 3 taken along a line IV-IV thereof.

As shown in FIGS. 3 and 4, the field emission device 220 further includes a cathode 212, a fluorescent layer 209, an anode 210, and an emitter 208 with an electron emitting end 222. The emitter 208, the anode 210, and the cathode 212 are disposed on the insulating substrate 202. The cathode 212 electrically connects to one of the row electrode down-leads 206. The fluorescent layer 209 is disposed on a surface of the anode 210. The anode 210 electrically connects to one of the column electrode down-leads 204. The emitter 208 electrically connects to the cathode 212, and the electron emitting end 222 of the emitter 208 faces the anode 210. When the field emission device 220 is operated, the electron emitting end 222 of the emitter 208 emits electrons. The anode 210 accelerates the emitted electrons to bombard the fluorescent layer 209 for luminance.

The cathode 212 is disposed between the first adjusting electrode 211 and the second adjusting electrode 213. The first adjusting electrode 211 and the second adjusting electrode 213 electrically connect to one of the row electrode down-leads 206, and are electrically isolated from the anode 210 and the column electrode down-leads 204. More specifically, the first adjusting electrode 211, the second adjusting electrode 213, and the cathode 212 electrically connect to the same row electrode down-leads 206, so that the first adjusting electrode 211, the second adjusting electrode 213, and the cathode 212 provide the same electrical potential. Thus, the first adjusting electrode 211 and the second adjusting electrode 213 generate a shielded effect to decrease deflection of the electrons emitted from the electron emitting end 222 of the emitter 208, and to avoid the electrons emitting into other field emission devices 220. In addition, the first adjusting electrode 211 and the second adjusting electrode 213 shield electrons emitted from other field emission devices 220.

The first adjusting electrode 211 and the second adjusting electrode 213 could be conductive thick liquid, metal, indium tin oxide (ITO), or any combination thereof. In one embodiment, the first adjusting electrode 211 and the second adjusting electrode 213 are made of conductive thick liquid, which includes powdered metal, powdered glass with a low fusion point, and binder. The powdered metal is powdered silver. The binder is terpineol or ethyl cellulose. A weight percentage of the powdered metal is in a range from about 50% to about 90%. A weight percentage of the powdered glass with the low fusion point is in a range from about 2% to about 10%. A weight percentage of the binder is in a range from about 8% to about 40%. The first adjusting electrode 211 and the second adjusting electrode 213 are made by printing or plating the conductive thick liquid onto the insulating substrate 202.

The first adjusting electrode 211 and the second adjusting electrode 213 could have a shape of a rectangle, an irregular shape, an ellipse, annularity, hyperbola, or parabola, corresponding to the different sizes of the spaces 214. In one embodiment, the first adjusting electrode 211 and the second adjusting electrode 213 are conductive cuboids. The thicknesses of the first adjusting electrode 211 and the second adjusting electrode 213 are individually in a range from about 15 micrometers to about 600 micrometers. More specifically, referring to FIGS. 2 and 4, the thickness of each of the first adjusting electrode 211 and the second adjusting electrode 213 is equal to or greater than a thickness of the emitter 208 and a thickness of the anode 210.

Relative to the X direction, the first adjusting electrode 211 has a length d1. The second adjusting electrode 213 has a length d2. A distance d3 is between the electron emitting end 222 and a top of the row electrode down-lead 206 electrically connected with the cathode 212. A distance between the top of the row electrode down-lead 206 and a top of the anode 210 is defined as d4. In one embodiment, each of d1 and d2 is equal to or greater than d3. Alternatively, in one embodiment, d2 is equal to or greater than d4 so that it is more efficient to avoid the electrons emitting into other field emission devices 220.

The column electrode down-leads 204 and the row electrode down-leads 206 could be conductive thick liquid, metal, or any combination thereof. In one embodiment, the column electrode down-leads 204 and the row electrode down-leads 206 are made of the same conductive thick liquid used in making the first adjusting electrode 211 and the second adjusting electrode 213. The regular interval of the column electrode down-leads 204 is in a range from about 50 micrometers to about 2 centimeters. Similarly, the regular interval of the row electrode down-leads 206 is in a range from about 50 micrometers to about 2 centimeters. Widths of the column electrode down-leads 204 and the row electrode down-leads 206 are in a range from about 30 micrometers to about 500 micrometers. Thicknesses of the column electrode down-leads 204 and the row electrode down-leads 206 are in a range from about 1 micrometers to about 100 micrometers. The column electrode down-leads 204 and the row electrode down-leads 206 are made by printing or plating the conductive thick liquid onto the insulating substrate 202.

The cathode 212 and the anode 210 could be conductive thick liquid, metal, or any combination thereof. Relative to the Y direction, lengths of the cathode 212 and the anode 210 are in a range from about 30 micrometers to about 1.5 centimeters. Relative to the X direction, widths of the cathode 212 and the anode 210 are in a range from about 20 micrometers to about 1 centimeter. Thicknesses of the cathode 212 and the anode 210 are in a range from about 1 micrometers to about 500 micrometers. In one embodiment, the cathode 212 and the anode 210 are conductive cuboids corresponding to the different sizes of the spaces 214, and also made of the same conductive thick liquid. The lengths of the cathode 212 and the anode 210 are in a range from about 10 micrometers to about 700 micrometers. The width of each of the cathode 212 and the anode 210 is in a range from about 5 micrometers to about 500 micrometers. The thickness of each of the cathode 212 and the anode 210 is in a range from about 1 micrometers to about 100 micrometers. The cathode 212 and the anode 210 are made by printing or plating the conductive thick liquid onto the insulating substrate 202.

The fluorescent layer 209 could be made by white phosphor powder or monochromatic phosphor powder, such as red phosphor powder, green phosphor powder, or blue phosphor powder. Further, the fluorescent layer 209 can be made by printing or plating the phosphor powder onto the surface of the anode 210. In one embodiment, a thickness of the fluorescent layer 209 is in a range from about 5 micrometers to about 50 micrometers.

The emitter 208 could be silicon wires, carbon nanotubes, carbon fibers, or carbon nanotube yarns. In one embodiment, a number of carbon nanotube yarns act as the emitter 208 and are arranged in parallel at an interval. More specifically, each of the carbon nanotube yarns includes a first end and a second end. The first end electrically connects to the cathode 212, and the second end as the electron emitting end 222, faces the anode 210. A length of each of the carbon nanotube yarns is in a range from about 10 micrometers to about 1 centimeter, and the interval of the carbon nanotube yarns is in a range from about 1 micrometer to about 1000 micrometers. A distance between the electron emitting end 222 and the anode 210 is in a range from about 1 micrometer to about 1000 micrometers. Each of the carbon nanotube yarns includes a number of carbon nanotubes. Specifically, each of the carbon nanotube yarns includes a number of carbon nanotube segments, which are joined end to end by van der Waals attractive force. In addition, each of the carbon nanotube segments includes substantially parallel carbon nanotubes. The carbon nanotubes of the present embodiment can be single-walled carbon nanotubes, double-walled carbon nanotubes, or multi-walled carbon nanotubes. A length of each carbon nanotube is in a range from about 10 micrometers to about 100 micrometers, and a diameter of each of the carbon nanotubes is less than about 15 nanometers.

Furthermore, the structure of the carbon nanotube yarns can be pure. The pure structure means the carbon nanotubes of the carbon nanotube yarns are not chemically treated or modified by functional groups. The carbon nanotube yarns have a free-standing structure. The term "free-standing structure" means that the emitter 208 can sustain the weight of itself when hoisted by a portion thereof, without any significant damage to its structural integrity. More specifically, a large number of the carbon nanotube yarns in the emitter 208 could be oriented along a preferred direction. An end of one carbon nanotube yarn is joined to another end of an adjacent carbon nanotube yarn arranged substantially along the same direction by van der Waals force.

A method for making the emitter 208 comprised of the above mentioned carbon nanotube yarns includes the steps of:

S10, providing a carbon nanotube film;

S20, placing the carbon nanotube film on the anode 210 and the cathode 212; and S30, cutting the carbon nanotube film to disconnect the carbon nanotube film between the anode 210 and the cathode 212 and form a number of substantially parallel carbon nanotube yarns acting as the emitter 208.

In step S10, the carbon nanotube film is a drawn carbon nanotube film formed by drawing a film from a carbon nanotube array capable of having a film drawn therefrom. The drawn carbon nanotube film includes a number of successive and oriented carbon nanotubes joined end-to-end by van der Waals force therebetween. The carbon nanotubes in the drawn carbon nanotube film can be substantially aligned along a single direction and substantially parallel to the surface of the carbon nanotube film.

In step S20, the carbon nanotubes of the carbon nanotube film extend from the cathode 212 to the anode 210. In one embodiment, a number of layers of the carbon nanotube film are in a range from 1 to 5. Furthermore, the carbon nanotube film is soaked in an organic solvent. During the surface treatment, a part of the carbon nanotube film is shrunk into a carbon nanotube linear structure after the organic solvent volatilizes, due to factors such as surface tension. The organic solvent may be a volatilizable organic solvent, such as ethanol, methanol, acetone, dichloroethane, chloroform, or any combination thereof.

Alternatively, carbon nanotube yarns fabricated by spinning technology can also be used as the emitter. The detailed fabrication process can be found in the previous patents of papers. Briefly, a method for fabricating the carbon nanotube yarns with spinning technology includes the steps of:

firstly, supplying the super-aligned carbon nanotube array;

secondly, drawing carbon nanotube film from the array; and thirdly, spinning the film into yarn shape during the drawing process with an optional step of passing the film spun into yarn shape through volatile solvent.

In step S30, a laser beam cuts the carbon nanotube film. More specifically, a laser beam with a predetermined width scans the carbon nanotube film along each of the column electrode down-leads 204 to remove the carbon nanotube film placed between different column electrodes. Afterward, another laser beam with another predetermined width scans the carbon nanotube film along each of the row electrode down-leads 206 to remove the carbon nanotube film placed between the row electrode down-lead 206 and the corresponding anode 210. Thus, the carbon nanotube film placed between the anode 210 and the cathode 212 in one of the spaces 214 can be disconnected from the anode 210. Furthermore, after cutting the carbon nanotube film, the broken portion of the carbon nanotube film acts as the electron emitting end 222. There is a gap between the electron emitting end 222 and the anode 210. In one embodiment, a power of the laser beam is in a range from about 10 watts to about 50 watts. A scan speed of the laser beam is in a range from about 0.1 millimeter per second to about 10000 millimeters per second. A width of the laser beam is in a range from about 1 micrometer to about 400 micrometers.

Each of the field emission devices 220 further includes a fixing element (not shown) disposed on the cathode 212. The emitter 208 is fixed on the cathode 212 by the fixing element. The insulating substrate 202 could be fabricated using porcelain, glass, resin, quartz, or any combination thereof. In one embodiment, the insulating substrate 202 is fabricated by glass, and a thickness of the insulating substrate 202 is greater than about 1 millimeter.

Figure 5:
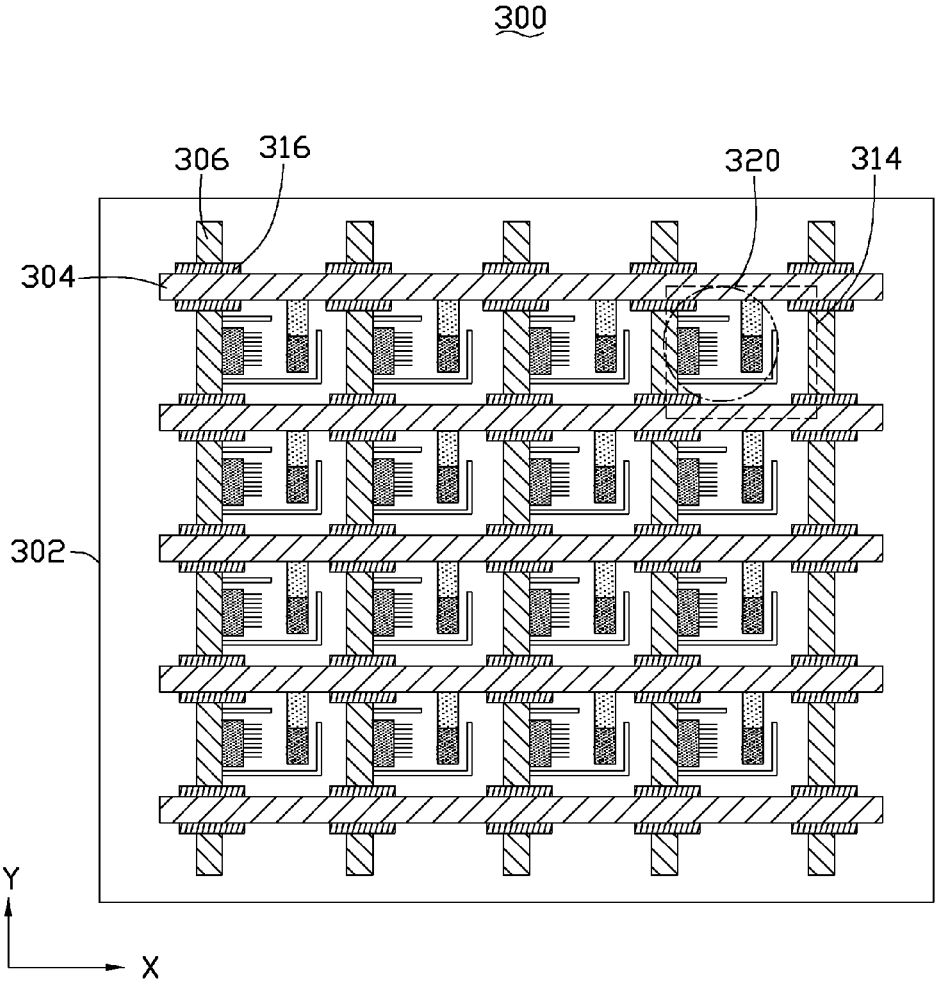
FIG. 5 is a schematic view of one embodiment of a field emission display.

According to another embodiment, a field emission display 300 as illustrated in FIG. 5 includes an insulating substrate 302, a number of column electrode down-leads 304, a number of row electrode down-leads 306, a number of isolating elements 316, and a number of field emission devices 320.

The row electrode down-leads 306 are disposed on the insulating substrate 302, and arranged substantially along a first direction, such as an X direction shown in FIG. 5, in parallel at a regular interval. Similarly, the column electrode down-leads 304 are disposed on the insulating substrate 302 and arranged substantially along a second direction, such as a Y direction shown in FIG. 5, in parallel at a regular interval. The first direction is substantially perpendicular to the second direction, and the isolating elements 316 electrically isolate the row electrode down-leads 306 from the column electrode down-leads 304 to avoid a short circuit between the row electrode down-leads 306 and the column electrode down-leads 304. Every two neighboring row electrode down-leads 306 and every two neighboring column electrode down-leads 304 define a grid 314. The field emission devices 320 are respectively disposed in the grids 314.

Figure 6:
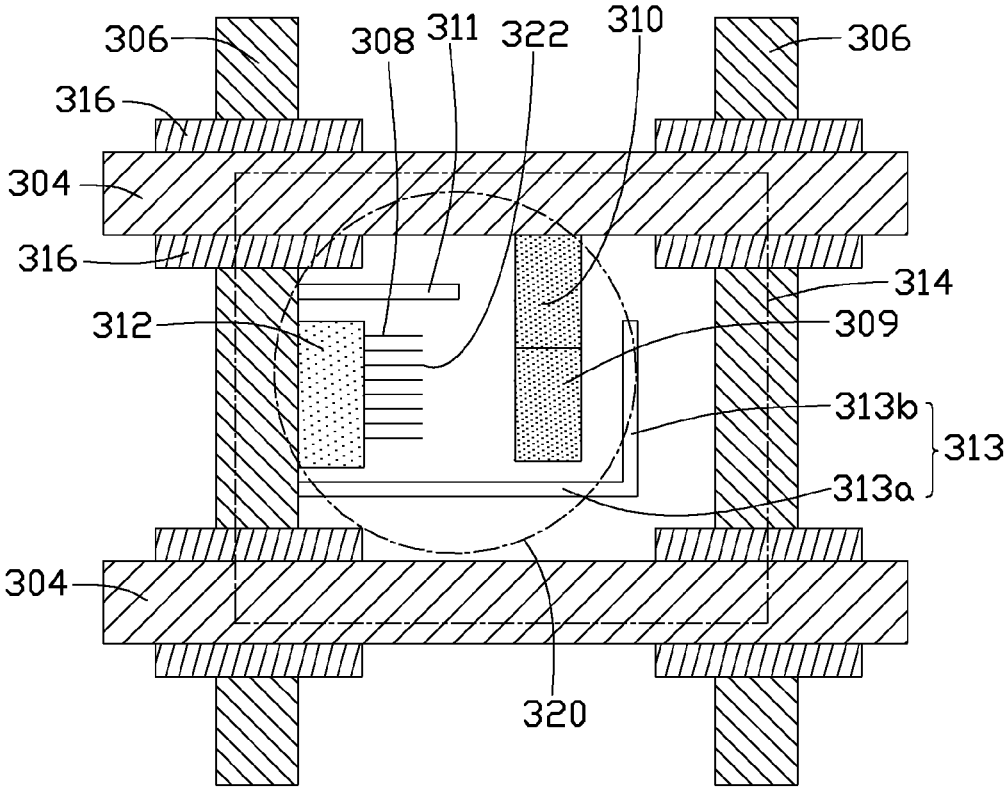
FIG. 6 is a schematic view of one embodiment of a field emission device of the field emission display shown in FIG. 5.
Figure 7:
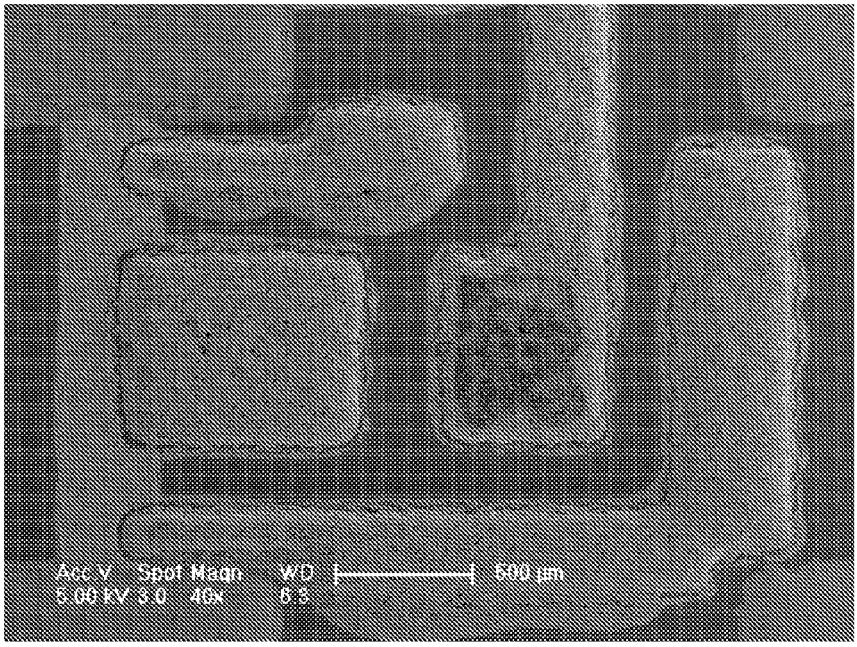
FIG. 7 shows a Scanning Electron Microscope (SEM) image of the field emission device shown in FIG. 6.

As shown in FIGS. 6 and 7, the field emission device 320 includes a cathode 312, a fluorescent layer 309, an anode 310, a first adjusting electrode 311, a second adjusting electrode 313, and an emitter 308 with an electron emitting end 322. The emitter 308, the anode 310, and the cathode 312 are disposed on the insulating substrate 302. The cathode 312 electrically connects to one of the row electrode down-leads 306. The fluorescent layer 309 is disposed near the anode 310. The anode 310 electrically connects to one of the column electrode down-leads 304. The emitter 308 electrically connects to the cathode 312, and the electron emitting end 322 of the emitter 308 faces the fluorescent layer 309 and the anode 310. When the field emission device 320 is operated, the electron emitting end 322 of the emitter 308 emits electrons. The anode 310 accelerates the emitted electrons to bombard the fluorescent layer 309 for luminance.

The cathode 312 is disposed between the first adjusting electrode 311 and the second adjusting electrode 313. The second adjusting electrode 313 includes a first sub-electrode 313*a* and a second sub-electrode 313*b*, and one end of the first sub-electrode 313*a* connects to one end of the second sub-electrode 313*b* to define an L-shaped structure. The first adjusting electrode 311 and the first sub-electrode 313*a* of the second adjusting electrode 313 of each of the field emission devices 320 are parallel to each other and extend substantially along the X direction. The second sub-electrode 313*b* of the second adjusting electrode 313 of each of the field emission devices 320 extend substantially along the Y direction.

The first adjusting electrode 311 and another end of the first sub-electrode 313*a* electrically connect to one of the row electrode down-leads 306. The first adjusting electrode 311, the first sub-electrode 313*a*, and a second sub-electrode 313*b* of the second adjusting electrode 313 are electrically isolated from the anode 310 and the column electrode down-leads 304. More specifically, the first adjusting electrode 311, the first sub-electrode 313*a* of the second adjusting electrode 313, and the cathode 312 electrically connect to the same row electrode down-leads 306, so that the first adjusting electrode 311, the second adjusting electrode 313, and the cathode 312 provide the same electrical potential. Thus, the first adjusting electrode 311 and the second adjusting electrode 313 generate a shielded effect to decrease deflection of the electrons emitted from the electron emitting end 322 of the emitter 308, and to avoid the electrons emitting into other field emission devices 320. In addition, the first adjusting electrode 311 and the second adjusting electrode 313 shield electrons emitted from other field emission devices 320.

Accordingly, the present disclosure is capable of providing a field mission device with two adjusting electrodes which generate a shielded effect to decrease deflection of electrons emitted from an emitter of the field mission device. Emission directions of the electrons could be controlled by the adjusting electrodes. Thus, a large amount of the electrons can bombard at least one fluorescent layer of the field mission device, and luminous efficiency of the field emission device is increased.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A field emission display, comprising:

an insulating substrate;

a plurality of row electrode down-leads disposed on the insulating substrate and arranged substantially along a first direction in parallel at an interval; and a plurality of field emission devices disposed on the insulating substrate, each of the plurality of field emission devices comprising:

a cathode;

an anode;

an emitter electrically connecting to the cathode;

a first adjusting electrode disposed on the insulating substrate; and a second adjusting electrode disposed on the insulating substrate, wherein the cathode, the first adjusting electrode, and the second adjusting electrode electrically connect to one of the plurality of row electrode down-leads, the cathode is disposed between the first adjusting electrode and the second adjusting electrode, and the first adjusting electrode and the second adjusting electrode are electrically isolated from the anode.

2. The field emission display as claimed in claim 1, further comprising a plurality of column electrode down-leads disposed on the insulating substrate and arranged substantially along a second direction in parallel at an interval, wherein the first direction is substantially perpendicular to the second direction.

3. The field emission display as claimed in claim 2, wherein the anode of each of the plurality of field emission devices electrically connects to one of the plurality of column electrode down-leads.

4. The field emission display as claimed in claim 2, wherein the first adjusting electrode and the second adjusting electrode are electrically isolated from the plurality of column electrode down-leads.

5. The field emission display as claimed in claim 2, wherein every two neighboring row electrode down-leads and every two neighboring column electrode down-leads define a space, and one of the plurality of field emission devices is disposed in the space.

6. The field emission display as claimed in claim 2, further comprising a plurality of isolating elements electrically isolating the plurality of row electrode down-leads from the plurality of column electrode down-leads.

7. The field emission display as claimed in claim 2, wherein the second adjusting electrode of each of the plurality of field emission devices comprises a first sub-electrode and a second sub-electrode connected to one end of the first sub-electrode to define an L-type structure.

8. The field emission display as claimed in claim 7, wherein the first sub-electrode extends substantially along the first direction, and the second sub-electrode extends substantially along the second direction.

9. The field emission display as claimed in claim 1, wherein a thickness of each of the first adjusting electrode and the second adjusting electrode along the first direction is equal to or greater than a thickness of the emitter and a thickness of the anode.

10. The field emission display as claimed in claim 9, wherein the thickness of each of the first adjusting electrode and the second adjusting electrode is in a range from about 15 micrometers to about 600 micrometers.

11. The field emission display as claimed in claim 1, wherein a length of each of the first adjusting electrode and the second adjusting electrode along the first direction is equal to or greater than a distance between a free end of the emitter and a top of one of the row electrode down-leads.

12. The field emission display as claimed in claim 11, wherein a length of the second adjusting electrode is equal to or greater than the length of the first adjusting electrode.

13. The field emission display as claimed in claim 11, wherein the length of the second adjusting electrode is equal to or greater than a distance between the top of the one of the row electrode down-leads and a top of the anode.

14. The field emission display as claimed in claim 13, wherein the second adjusting electrode extends beyond the top of the anode.

15. The field emission display as claimed in claim 14, wherein the second adjusting electrode has an L-shaped configuration.

16. The field emission display as claimed in claim 1, wherein the emitter comprises a plurality of carbon nanotube yarns arranged in parallel at an interval, each of the plurality of carbon nanotube yarns comprises a plurality of carbon nanotube segments which are joined end to end by van der Waals attractive force.

17. The field emission display as claimed in claim 14, wherein each of the plurality of carbon nanotube yarns comprises a first end electrically connected to the cathode and a second end facing the anode.

18. A field emission display comprising a plurality of row electrode down-leads arranged substantially along a first direction in parallel, a plurality of column electrode down-leads arranged substantially along a second direction in parallel, and a plurality of field emission devices, the first direction being substantially perpendicular to the second direction, each of the plurality of the field emission devices comprising:

a cathode;

an emitter electrically connecting to the cathode;

a first adjusting electrode; and a second adjusting electrode, wherein the cathode, the first adjusting electrode, and the second adjusting electrode electrically connect to one of the plurality of row electrode down-leads, and the cathode is disposed between the first adjusting electrode and the second adjusting electrode.

19. The field emission display as claimed in claim 18, wherein each of the plurality of the field emission devices further comprises an anode, wherein the first adjusting electrode and the second adjusting electrode are electrically isolated from the anode and the plurality of column electrode down-leads.

20. The field emission display as claimed in claim 18, wherein a length of each of the first adjusting electrode and the second adjusting electrode along the first direction is equal to or greater than a distance between a free end of the emitter and a top of one of the row electrode down-leads.

* * * * *